US009155338B2

(12) United States Patent
Mazursky

(10) Patent No.: US 9,155,338 B2
(45) Date of Patent: Oct. 13, 2015

(54) OBJECTS WITH BUILT-IN, VARIABLY-SIZED, REMOVABLE PORTIONS

(71) Applicant: PDQ Mazoo, LLC, Riverwoods, IL (US)

(72) Inventor: Richard B. Mazursky, Riverwoods, IL (US)

(73) Assignee: PDQ MAZOO, LLC, Riverwoods, IL (US)

( * ) Notice: Subject to any disclaimer, the term of this patent is extended or adjusted under 35 U.S.C. 154(b) by 308 days.

(21) Appl. No.: 13/646,054

(22) Filed: Oct. 5, 2012

(65) Prior Publication Data

US 2013/0089691 A1 Apr. 11, 2013

Related U.S. Application Data

(60) Provisional application No. 61/545,314, filed on Oct. 10, 2011.

(51) Int. Cl.

| | |
|---|---|
| ***B32B 3/06*** | (2006.01) |
| ***A41B 13/10*** | (2006.01) |
| ***A47K 10/16*** | (2006.01) |
| ***F41H 5/04*** | (2006.01) |

(52) U.S. Cl.
CPC ..... *A41B 13/10* (2013.01); *A47K 10/16* (2013.01); *F41H 5/0492* (2013.01); *E01C 2201/12* (2013.01); *Y10T 428/15* (2015.01)

(58) Field of Classification Search
CPC .... A47K 10/16; E01C 2201/12; F47H 5/0492
USPC ..... 428/43, 44, 51
See application file for complete search history.

(56) References Cited

U.S. PATENT DOCUMENTS 3,940,884 A * 3/1976 Mason, Jr. ..... 47/32
6,663,610 B1 * 12/2003 Thompson et al. ..... 604/313

* cited by examiner

*Primary Examiner* — Brent O'Hern
(74) *Attorney, Agent, or Firm* — McAndrews, Held & Malloy, Ltd.

(57) ABSTRACT

Certain embodiments provide a variably-sized removable portion integrated into an object. The object may include a surface and a variably-sized removable portion that includes separation edges that define a shape of the variably-sized removable portion. In certain embodiments, each of the separation edges is a different size and is concentrically-aligned with each other. Certain embodiments provide that each of the separations edges is separable from the surface of the object such that a size of an opening left when one of the separation edges is separated from the surface is variable depending on the size of the separation edge selected to be separated from the surface.

22 Claims, 3 Drawing Sheets

OBJECTS WITH BUILT-IN, VARIABLY-SIZED, REMOVABLE PORTIONS

CROSS-REFERENCE TO RELATED APPLICATIONS/INCORPORATION BY REFERENCE

This patent application makes reference to, claims priority to and claims benefit from U.S. Provisional Patent Application Ser. No. 61/545,314, entitled "Objects with Built-In, Variably-Sized, Removable Portions," filed on Oct. 10, 2011, the complete subject matter of which is hereby incorporated herein by reference, in its entirety.

FEDERALLY SPONSORED RESEARCH OR DEVELOPMENT

[Not Applicable]

SEQUENCE LISTING

[Not Applicable]

MICROFICHE/COPYRIGHT REFERENCE

[Not Applicable]

BACKGROUND OF THE INVENTION

The present invention generally relates to objects manufactured as defining one or more openings. More specifically, certain embodiments provide removable portions integrated into an object for creating a variably-sized opening within the object.

Currently, a wide variety of products are manufactured as defining one or more openings. For example, door hangers with messages like "DO NOT DISTURB" are manufactured to define an opening for fitting around a door knob or handle. As another example, bibs are manufactured to define an opening for fitting over a wearer's head or around a wearer's neck. However, in most cases, the size of the opening defined by the object is predefined and non-adjustable. In many instances, predefined, non-adjustable openings defined by an object may not be large or small enough to meet the preferences of a user. In some cases, when the predefined, non-adjustable openings defined by an object are too large or too small, the object may be unusable, objectionable or not optimized for an intended purpose of the user.

Thus, there is a need for providing removable portions integrated into an object for creating a variably-sized opening within the object.

Further limitations and disadvantages of conventional and traditional approaches will become apparent to one of skill in the art, through comparison of such systems and methods with the present invention as set forth in the remainder of the present application with reference to the drawings.

BRIEF SUMMARY OF THE INVENTION

Objects with built-in, variably-sized, removable portions are provided, substantially as shown in and/or described in connection with at least one of the figures, as set forth more completely in the claims.

These and other advantages, aspects and novel features of the present invention, as well as details of illustrative aspects thereof, will be more fully understood from the following description and drawings.

Figure 1:
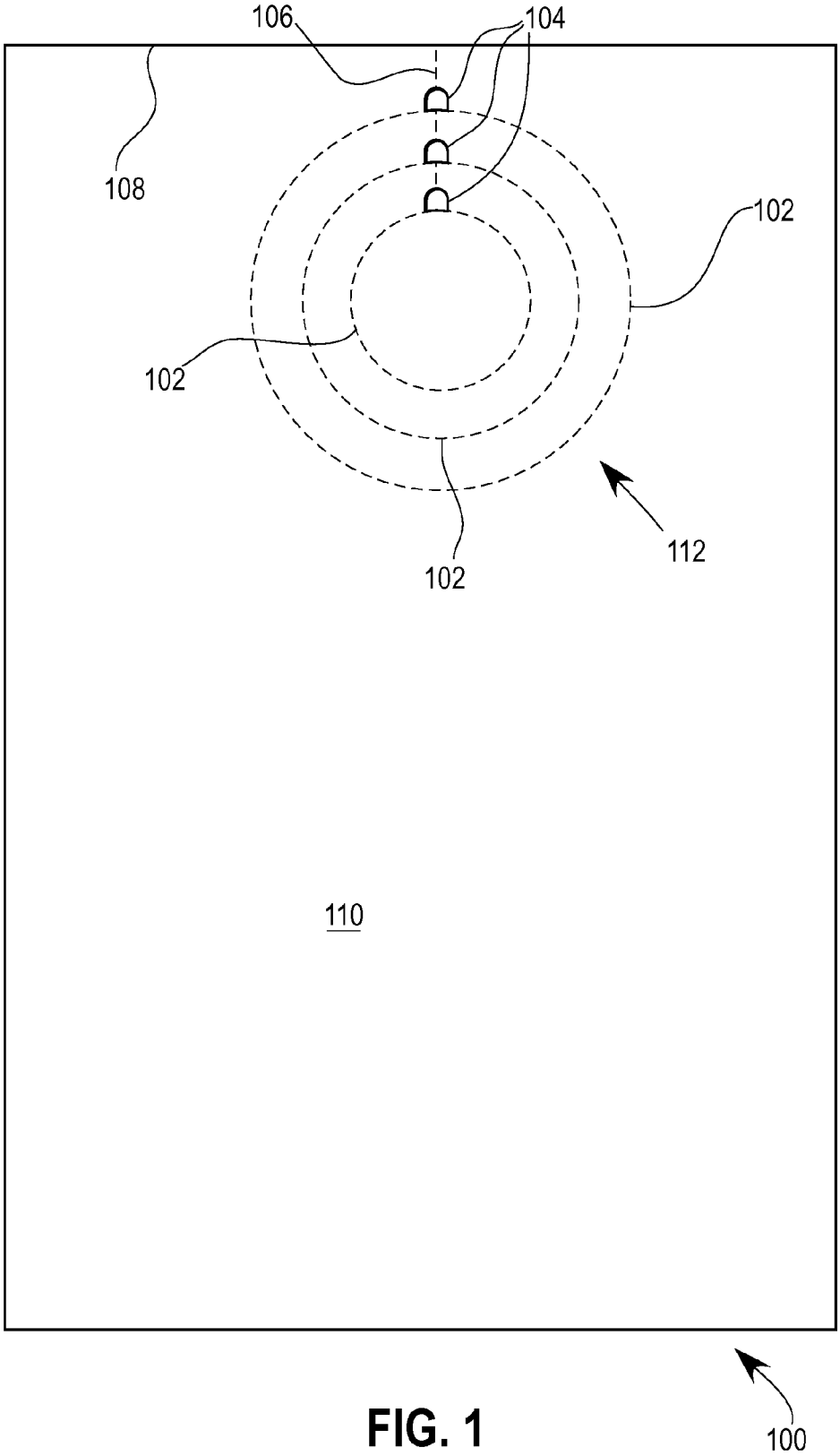
FIG. 1 is a diagram that illustrates an exemplary variably-sized removable portion built into an object in accordance with an embodiment of the present invention.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the present invention relate to removable portions integrated into an object for creating a variably-sized opening within the object.

Various embodiments of the present invention provide for a variably-sized removable portion 112, 212, 312, 314 integrated into an object 100, 200, 300. The object 100, 200, 300 comprises a surface 110, 210, 310 and a variably-sized removable portion 112, 212, 312, 314. The variably-sized removable portion 112, 212, 312, 314 comprises a plurality of separation edges 102, 202, 302 that define a shape of the variable-sized removable portion 112, 212, 312, 314. In certain embodiments, each of the plurality of separation edges 102, 202, 302 is a different size and is concentrically-aligned with each other. Certain embodiments provide that each of the plurality of separations edges 102, 202, 302 is separable from the surface 110, 210, 310 of the object 100, 200, 300 such that a size of an opening left when one of the plurality of separation edges 102, 202, 302 is separated from the surface 110, 210, 310 is variable depending on the size of the one of the plurality of separation edges 102, 202, 302 selected to be separated from the surface 110, 210, 310.

FIG. 1 is a diagram that illustrates an exemplary variably-sized removable portion 112 built into an object 100 in accordance with an embodiment of the present invention. Object 100 may include at least one surface 110 and at least one perimeter 108. In certain embodiments, the object 100 may be a sheet of paper, plastic, cloth or any other suitable material. The object 100 may have a variety of different purposes. For example, object 100 may be a bib or surgical gown, among other things, where when the variably-sized removable portion 112 is removed from the object, an opening left may fit around the head of a user. As another example, object 100 may be a message hanger, where a message may be provided on the surface 110 of object 100, and when the variably-sized removable portion 112 is removed from the object 100, an opening left may fit around a door knob, a door handle, a telephone, a pencil box, or any other suitable article. Unless so claimed, the scope of various aspects of the present invention should not be limited to a particular object type.

Figure 2:
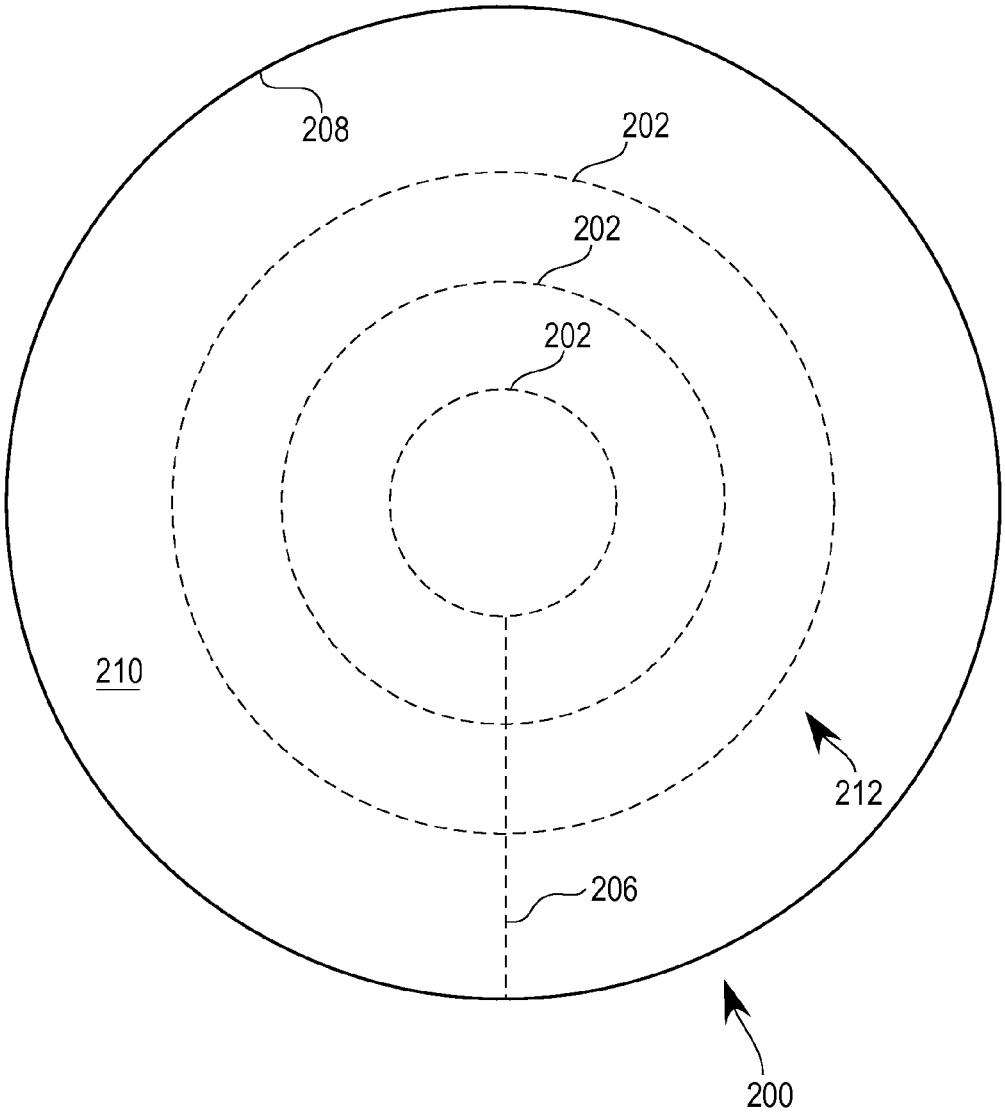
FIG. 2 is a diagram that illustrates an exemplary variably-sized removable portion built into an object in accordance with an embodiment of the present invention.
Figure 3:
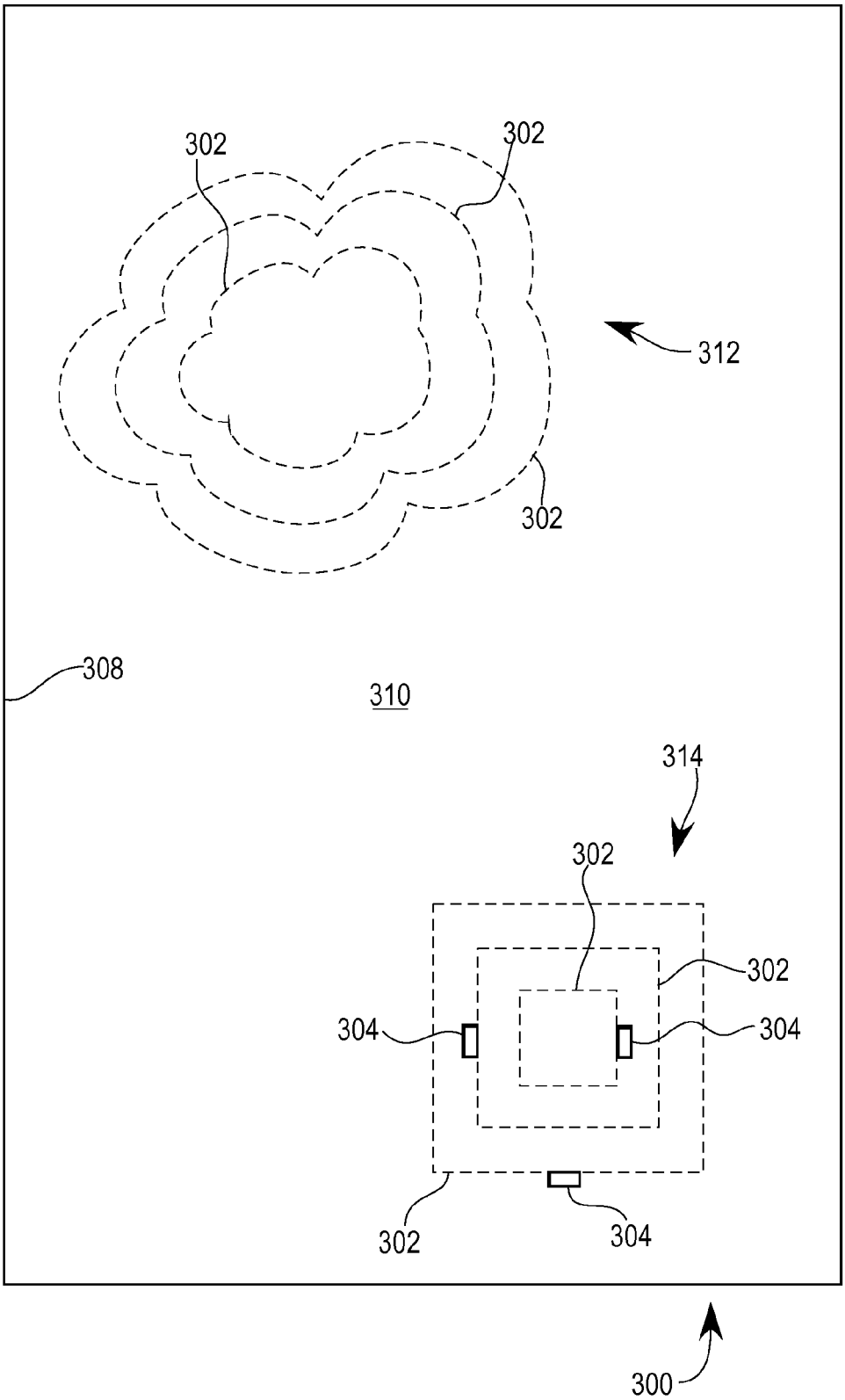
FIG. 3 is a diagram that illustrates exemplary variably-sized removable portions built into an object an in accordance with an embodiment of the present invention.

Although the object 100 in FIG. 1 is illustrated as having one variably-sized removable portion embodiment 112, the object 100 may include more variably-sized removable portion embodiments 112 in various locations on the surface 110 of object 100 (as illustrated in FIG. 3, for example). Although the object 100 in FIG. 1 is illustrated as having a rectangular-shaped perimeter 108, the perimeter 108 of the object 100 may be any suitable shape (as illustrated in FIG. 2, for example).

Certain embodiments provide one or more variably-sized removable portions 112 for removal from an object 100 to provide an opening size in the object 100 that is selectable by a user. The shape and size of the one or more variably-sized removable portions 112 may be defined by separation edges 102. Further, the one or more variably-sized removable portions 112 may comprise one or more apertures 104 and one or more object removing edges 106 as discussed in more detail below. The one or more variably-sized removable portions 112 may be of various shapes, sizes, or the like, as illustrated in the exemplary variably-sized removable portion embodiments 112, 212, 312, 314 illustrated in FIGS. 1-3.

The variably-sized removable portion embodiment 112 of object 100 may include separation edges 102, for defining the shape of the variably-sized removable portion 112 and allowing separation of the variably-sized removable portion 112 from surface 110 of object 100. In certain embodiments, the separation edges 102 may be perforations or a clean cut, among other things. In certain embodiments, each of the separation edges 102 may be concentrically-aligned with the other separation edges 102. Each of the concentrically-aligned separation edges 102 may be the same shape; however, the shape of each of the concentrically-aligned separation edges 102 may be different sizes. For example, in the variably-sized removable portion embodiment 112 of FIG. 1, three separation edges 102 are illustrated as being aligned concentrically as difference sized circular shapes. In certain embodiments, each of the separation edges 102 of the variably-sized removable portion 112 may be separable from the surface 110 of object 100 such that the size of an opening left when a separation edge 102 is separated from the surface 110 is variable depending on the size of the shape associated with the separation edge 102 selected to be separated from the surface 110. The separation edges 102 may be of various quantities, shapes, sizes, among other things, as illustrated in the exemplary variably-sized removable portion embodiments 112, 212, 312, 314 illustrated in FIGS. 1-3.

In certain embodiments, one or more of the separation edges 102 of the variably-sized removable portion 112 may also include an aperture 104. As illustrated in FIGS. 1 and 3, for example, aperture(s) 104, 304 may be adjacent to and correspond with the separation edges 102, 302. The separations edges 102, 302 may be a different size and/or a different character (e.g., perforations, clean cut, etc.) than the size and/or character of the aperture(s) 104, 304, as illustrated in FIGS. 1 and 3. The apertures 104 may be used (as illustrated in variably-sized removable portion embodiments 112, 314, for example) to assist in separating the variably-sized removable portion 112 from the object 100 at the selected separation edge 102 such that the opening left in the object 100 is of the selected size. For example, a user may insert one or more fingers (or any other suitable object or tool) through the aperture 104 in order to grasp or otherwise apply pressure to the variably-sized removable portion 112 such that the variably-sized removable portion 112 may be separated from the object 100 at the selected separation edge 102. Additionally or alternatively, a tab (not shown) attached adjacent to one or more of the separation edges 102 may be used with aperture 104 to assist in separating the variably-sized removable portion 112 from the object 100 at the selected separation edge 102. In certain embodiments, the tab may be the same size and shape as aperture 104. The at least one aperture 104 may be in various shapes and sizes. In certain embodiments, user instructions for removing the variably-sized removable portion 112 using the aperture(s) 104 may be printed, embossed, perforated, pinpointed, or the like on surface 110 of object 100.

Certain embodiments provide one or more object removing edges 106 for removing the object 100 when the object 100 is no longer needed. As an example, after using a bib 100 or surgical gown 100, a user may separate the removing edge 106 so that the soiled bib 100 or surgical gown 100 does not need to be pulled back over the user's head to remove the object 100. In certain embodiments, the object removing edge 106 may be perforations or a clean cut, among other things. As illustrated in FIG. 1, the object removing edges 106 may be a different size and/or a different character (e.g., perforations, clean cut, etc.) than the size and/or character of the aperture(s) 104. The object removing edge 106 may extend from adjacent to the smallest separation edge shape 102 to the perimeter 108 of the object 100 such that the object removing edge 106 is usable irrespective of the selected separation edge 102. The object removing edge 106 may be of various quantities, lengths, sizes, trajectories, among other things, as illustrated in the exemplary variably-sized removable portion embodiments 112, 212 illustrated in FIGS. 1-2.

In certain embodiments, an object 100 may be manufactured or retrofitted with one or more of any of the exemplary variably-sized removable portion embodiments 112, 212, 312, 314, or the like. The one or more devices used to manufacture or retrofit the object 100 with variably-sized removable portion(s) 112, 212, 312, 314 may be, for example, a battery operated machine, hand operated machine, or any other suitably powered machine. In an embodiment, a die cutting process, among other things (e.g., stamped, laser cut, formed, etc.), may be used to manufacture the object 100 such that the one or more exemplary variably-sized removable portion embodiments 112, 212, 312, 314, or the like may be created in a continuous process with the object 100. For example, with regard to an object 100, rotary dies having cutting, creasing and perforation rules may cut the shape of the object 100 and provide any separation edges 102, apertures 104, and object removing edges of the variably-sized removable portions 112, 212, 312, 314. Unless so claimed, the scope of various aspects of the present invention should not be limited by the manufacturing process for creating the object 100 with the one or more exemplary variably-sized removable portion embodiments 112, 212, 312, 314, or the like.

FIG. 2 is a diagram that illustrates an exemplary variably-sized removable portion 212 built into an object 200 in accordance with an embodiment of the present invention. Object 200 may include at least one surface 210 and at least one perimeter 208. In certain embodiments, the object 200 may be a sheet of paper, plastic, cloth or any other suitable material. The object 200 may have a variety of different purposes. For example, object 200 may be a paint splatter mat or protection for a paint can, paint brush or roller, among other things, where when the variably-sized removable portion 212 is removed from the object, an opening left may fit snugly around a can of paint. Unless so claimed, the scope of various aspects of the present invention should not be limited to a particular object type.

Although the object 200 in FIG. 2 is illustrated as having one variably-sized removable portion embodiment 212, the object 100 may include more variably-sized removable portion embodiments 212 in various locations on the surface 210 of object 200 (as illustrated in FIG. 3, for example). Although the object 200 in FIG. 2 is illustrated as having a circular-shaped perimeter 208, the perimeter 208 of the object 200 may be any suitable shape (as illustrated in FIGS. 1 and 3, for example).

Referring to FIG. 2, certain embodiments provide one or more variably-sized removable portions 212 for removal from an object 200 to provide an opening size in the object 200 that is selectable by a user. The shape and size of the one or more variably-sized removable portions 212 may be defined by separation edges 202. Further, the one or more variably-sized removable portions 212 may comprise one or more object removing edges 206. Exemplary variably-sized removable portion embodiment 212 illustrates an exemplary embodiment without an aperture. In order to separate a variably-sized removable portion 212 without an aperture from the object 200, pressure may be applied to the selected separation edge 202 to separate the variably-sized removable portion 212 from the object 200 at the separation edge 202. The one or more variably-sized removable portions 212 may be of various shapes, sizes, or the like, as illustrated in the exemplary variably-sized removable portion embodiments 112, 212, 312, 314 illustrated in FIGS. 1-3.

The object 200 including the variably-sized removable portion 212 illustrated in FIG. 2 shares various characteristics with the object 100 including the variably-sized removable portion 112 illustrated in FIG. 1 as described above.

FIG. 3 is a diagram that illustrates exemplary variably-sized removable portions 312, 314 built into an object 300 in accordance with an embodiment of the present invention. Object 300 may include at least one surface 310 and at least one perimeter 308. In certain embodiments, the object 300 may be a sheet of paper, plastic, cloth or any other suitable material. The object 300 may have a variety of different purposes. For example, object 300 may be a sheet of tarpaulin, among other things, for covering machinery, vehicles, and the like, where when one or more of the variably-sized removable portions 312, 314 are removed from the object 300, an opening left may fit a desired accessible/exposed area size while maintaining coverage of the rest of the machinery, vehicle, telescope, military weapon, or the like. Unless so claimed, the scope of various aspects of the present invention should not be limited to a particular object type.

Although the object 300 in FIG. 3 is illustrated as having two variably-sized removable portion embodiments 312, 314, the object 100 may include more or less variably-sized removable portion embodiments 312, 314 in various locations on the surface 310 of object 300 (as illustrated in FIGS. 1-2, for example). Although the object 300 in FIG. 3 is illustrated as having a rectangular-shaped perimeter 308, the perimeter 308 of the object 300 may be any suitable shape (as illustrated in FIG. 2, for example).

Referring to FIG. 3, certain embodiments provide one or more variably-sized removable portions 312, 314 for removal from an object 300 to provide an opening size in the object 300 that is selectable by a user. The shape and size of the one or more variably-sized removable portions 312, 314 may be defined by separation edges 302. Further, the one or more variably-sized removable portions 314 may comprise one or more apertures 304. Exemplary variably-sized removable portion embodiment 312 illustrates an exemplary embodiment without an aperture. In order to separate a variably-sized removable portion 312 without an aperture from the object 300, pressure may be applied to the selected separation edge 302 to separate the variably-sized removable portion 312 from the object 300 at the separation edge 302. The one or more variably-sized removable portions 312 may be of various shapes, sizes, or the like, as illustrated in the exemplary variably-sized removable portion embodiments 112, 212, 312, 314 illustrated in FIGS. 1-3.

The object 300 including the variably-sized removable portions 312, 314 illustrated in FIG. 3 shares various characteristics with the objects 100, 200 including the variably-sized removable portions 112, 212 illustrated in FIGS. 1-2 as described above.

Thus, certain embodiments may allow a size of an opening within an object 100, 200, 300 to be selected based on a selection to remove a portion 112, 212, 312, 314 of an object 100, 200, 300 at one of a plurality of separation edges 102, 202, 302.

Certain embodiments of the present invention provide for a variably-sized removable portion 112, 212, 312, 314 integrated into an object 100, 200, 300. The object 100, 200, 300 comprises a surface 110, 210, 310 and a variably-sized removable portion 112, 212, 312, 314. The variably-sized removable portion 112, 212, 312, 314 comprises a plurality of separation edges 102, 202, 302 that define a shape of the variable-sized removable portion 112, 212, 312, 314. In certain embodiments, each of the plurality of separation edges 102, 202, 302 is a different size and is concentrically-aligned with each other. Certain embodiments provide that each of the plurality of separations edges 102, 202, 302 is separable from the surface 110, 210, 310 of the object 100, 200, 300 such that a size of an opening left when one of the plurality of separation edges 102, 202, 302 is separated from the surface 110, 210, 310 is variable depending on the size of the one of the plurality of separation edges 102, 202, 302 selected to be separated from the surface 110, 210, 310.

In various embodiments, the variably-sized removable portion 112, 212, 312, 314 comprises one or more apertures 104, 304 corresponding to at least one of the plurality of separation edges 102, 202, 302.

In certain embodiments, the variably-sized removable portion 112, 212, 312, 314 comprises one or more tabs attached adjacent to at least one of the plurality of separation edges 102, 202, 302.

In various embodiments, the one or more apertures 104, 304 and the one or more tabs are substantially a same shape and size.

In certain embodiments, the surface 110, 210, 310 comprises user instructions for removing the variably-sized removable portion 112, 212, 312, 314 using the one or more apertures 104, 304.

In various embodiments, the object 100, 200, 300 comprises a perimeter 108, 208, 308. The variably-sized removable portion 112, 212, 312, 314 comprises an object removing edge 106, 206 extending from adjacent to a smallest separation edge 102, 202, 302 of the plurality of separation edges 102, 202, 302 to the perimeter 108, 208, 308 of the object 100, 200, 300.

In certain embodiments, the object removing edge 106, 206 is at least one of perforations and a clean cut.

In various embodiments, the plurality of separation edges 102, 202, 302 are at least one of perforations and a clean cut.

In certain embodiments, each of the plurality of separation edges 102, 202, 302 is substantially a same shape.

In various embodiments, the object 100, 200, 300 comprises a plurality of variably-sized removable portions 112, 212, 312, 314.

In certain embodiments, the object 100, 200, 300 comprises a circular-shaped perimeter 208.

In various embodiments, the object 100, 200, 300 comprises a rectangular-shaped perimeter 108, 308.

In certain embodiments, the variably-sized removable portion 112, 212, 312, 314 is built into the object 100, 200, 300 using a die cutting process.

In various embodiments, the object 100, 200, 300 is a sheet of at least one of paper, plastic, tarpaulin, and cloth.

In certain embodiments, the object 100, 200, 300 is at least one of a bib, a gown, a message hanger, a paint splatter mat, and an equipment cover.

While the invention has been described with reference to certain embodiments, it may be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention may include all embodiments falling within the scope of the appended claims.

The invention claimed is:

1. An object comprising:

a surface; and a variably-sized removable portion comprising cuts, the cuts consisting of:

a plurality of separation edges that define a shape of the variably-sized removable portion, wherein each of the plurality of separation edges is a different size and is concentrically-aligned with each other, and at least one aperture adjacent to and corresponding with each of a plurality of the plurality of separation edges, the at least one aperture being one or more of a different size or a different character than the plurality of separation edges, wherein the character of the plurality of separation edges comprises at least one of perforations and a clean cut, and wherein each of the plurality of separations edges is separable from the surface of the object using the at least one aperture such that a size of an opening left when one of the plurality of separation edges is separated from the surface is variable depending on the size of the one of the plurality of separation edges selected to be separated from the surface.

2. The object of claim 1, wherein the variably-sized removable portion comprises at least one tab attached adjacent to at least one of the plurality of separation edges.

3. The object of claim 2, wherein the at least one aperture and the at least tab are substantially a same shape and size.

4. The object of claim 1, wherein the surface comprises user instructions for removing the variably-sized removable portion using the at least one aperture.

5. The object of claim 1, wherein each of the plurality of separation edges is substantially a same shape.

6. The object of claim 1, comprising a plurality of variably-sized removable portions.

7. The object of claim 1, comprising a circular-shaped perimeter.

8. The object of claim 1, comprising a rectangular-shaped perimeter.

9. The object of claim 1, wherein the variably-sized removable portion is built into the object using a die cutting process.

10. The object of claim 1, wherein the object is a sheet of at least one of:

paper,
plastic,
tarpaulin, and
cloth.

11. The object of claim 1, wherein the object is at least one of:

a bib,
a gown,
a message hanger,
a paint splatter mat, and
an equipment cover.

12. An object comprising:

a surface;

a perimeter: and a variably-sized removable portion comprising cuts, the cuts consisting of:

a plurality of separation edges that define a shape of the variably-sized removable portion, wherein each of the plurality of separation edges is a different size and is concentrically-aligned with each other, at least one aperture adjacent to and corresponding with each of a plurality of the plurality of separation edges, the at least one aperture being one or more of a different size or a different character than the plurality of separation edges, wherein the character of the plurality of separation edges comprises at least one of perforations and a clean cut, and an object removing edge extending from adjacent to a smallest separation edge of the plurality of separation edges to the perimeter of the object, the at least one aperture being one or more of a different size or a different character than the object removing edge, wherein the character of the object removing edge comprises at least one of perforations and a clean cut, and wherein each of the plurality of separations edges is separable from the surface of the object using the at least one aperture such that a size of an opening left when one of the plurality of separation edges is separated from the surface is variable depending on the size of the one of the plurality of separation edges selected to be separated from the surface.

13. The object of claim 12, wherein the variably-sized removable portion comprises at least one tab attached adjacent to at least one of the plurality of separation edges.

14. The object of claim 13, wherein the at least one aperture and the at least tab are substantially a same shape and size.

15. The object of claim 12, wherein the surface comprises user instructions for removing the variably-sized removable portion using the at least one aperture.

16. The object of claim 12, wherein each of the plurality of separation edges is substantially a same shape.

17. The object of claim 12, comprising a plurality of variably-sized removable portions.

18. The object of claim 12, comprising a circular-shaped perimeter.

19. The object of claim 12, comprising a rectangular-shaped perimeter.

20. The object of claim 12, wherein the variably-sized removable portion is built into the object using a die cutting process.

21. The object of claim 12, wherein the object is a sheet of at least one of:

paper,
plastic,
tarpaulin, and
cloth.

22. The object of claim 12, wherein the object is at least one of:

a bib,
a gown,
a message hanger,
a paint splatter mat, and
an equipment cover.

* * * * *